US009982523B2

(12) United States Patent
Ciezobka et al.

(10) Patent No.: US 9,982,523 B2
(45) Date of Patent: May 29, 2018

(54) HYDRAULIC FRACTURING SYSTEM AND METHOD

(71) Applicant: GAS TECHNOLOGY INSTITUTE, Des Plaines, IL (US)

(72) Inventors: Jordan Ciezobka, Addison, IL (US); Debotyam Maity, Des Plaines, IL (US)

(73) Assignee: GAS TECHNOLOGY INSTITUTE, Des Plaines, IL (US)

( * ) Notice: Subject to any disclaimer, the term of this patent is extended or adjusted under 35 U.S.C. 154(b) by 0 days. days.

(21) Appl. No.: 15/464,939

(22) Filed: Mar. 21, 2017

(65) Prior Publication Data

US 2017/0226838 A1 Aug. 10, 2017

Related U.S. Application Data

(63) Continuation-in-part of application No. 15/445,044, filed on Feb. 28, 2017, which is a continuation of application No. 14/469,065, filed on Aug. 26, 2014, now Pat. No. 9,581,004.

(60) Provisional application No. 62/311,127, filed on Mar. 21, 2016, provisional application No. 62/339,233, filed on May 20, 2016.

(51) Int. Cl.
*E21B 43/26* (2006.01)
*E21B 49/00* (2006.01)

(52) U.S. Cl.
CPC ..... *E21B 43/26* (2013.01); *E21B 49/00* (2013.01)

(58) Field of Classification Search
CPC ..... E21B 43/26; E21B 43/003; E21B 28/00; E21B 43/263; E21B 43/267; E21B 47/18; E21B 47/187
See application file for complete search history.

(56) References Cited

U.S. PATENT DOCUMENTS

| | | | |
|---|---|---|---|
| 2,915,122 | A | 12/1958 | Hulse |
| 3,048,226 | A | 8/1962 | Smith |
| 3,602,311 | A | 8/1971 | Whitsitt |
| 3,933,205 | A | 1/1976 | Kiel |
| 3,965,982 | A | 6/1976 | Medlin |
| 5,536,115 | A | 7/1996 | Keck |
| 9,581,004 | B2 | 2/2017 | Ciezobka et al. |
| 2005/0230117 | A1* | 10/2005 | Wilkinson |
| 2012/0199356 | A1 | 8/2012 | Nichols |
| 2014/0014338 | A1 | 1/2014 | Crews et al. |
| 2014/0060831 | A1* | 3/2014 | Miller |
| 2014/0251623 | A1 | 9/2014 | Lestz et al. |
| 2015/0192117 | A1 | 7/2015 | Bridges |

OTHER PUBLICATIONS

Ciezobka, J., "Marcellus Gas Shale Project," RPSEA Industry Workshop: Summary of Results for Completed GTI Marcellus Shale R&D Project, Canonsburg, PA, May 7, 2013 (27 pages).

(Continued)

*Primary Examiner* — Zakiya W Bates
(74) *Attorney, Agent, or Firm* — Pauley Erickson & Kottis

(57) ABSTRACT

A hydraulic fracturing system and method for enhancing effective permeability of earth formations to increase hydrocarbon production, enhance operation efficiency by reducing fluid entry friction due to tortuosity and perforation, and to open perforations that are either unopened or not effective using traditional techniques, by varying a pump rate and/or a flow rate to a wellbore.

22 Claims, 11 Drawing Sheets

(56) References Cited

OTHER PUBLICATIONS

Co-pending U.S. Appl. No. 15/445,044, Ciezobka et al., "Hydraulic Fracturing System and Method," filed Feb. 28, 2017.
Co-pending U.S. Appl. No. 15/600,155, Ciezobka et al., "Hydraulic Fracturing System and Method," filed May 19, 2017.

* cited by examiner

Figure 8: Rate fluctuations introduced in rapid succession at 21st minute and 23rd minute of treatment and corresponding pressure profile for a representative completion.

Figure 9: Schematic showing proposed experimental design for variable rate fluctuations workflow outlined in the discussion.

Figure 10: Results from proposed experimental workflow to design variable rate fluctuations for optimizing perforation opening.

Figure 11: Perforation opening "synthetic curves" and three potential scenarios in terms of opening of additional perforations due to introduced rate fluctuations "r".

Figure 12: Observed opening of perforations for an actual treatment stage from the Permian Basin.

Figure 13: Surface geophone locations (red dots) and borehole projection (blue insert) at 1000's of feet below surface.

Figure 14: Using microseismic attributes to diagnose completion effectiveness.

HYDRAULIC FRACTURING SYSTEM AND METHOD

CROSS REFERENCE TO RELATED APPLICATIONS

This application is a continuation-in-part application of application, U.S. Ser. No. 15/445,044, filed on 28 Feb. 2017, which in turn is a continuation application of application, U.S. Ser. No. 14/469,065, filed on 26 Aug. 2014. The co-pending parent application is hereby incorporated by reference herein and is made a part hereof, including but not limited to those portions which specifically appear hereinafter.

This application also claims the benefit of U.S. Provisional Patent Application, Ser. No. 62/311,127, filed on 21 Mar. 2016, and U.S. Provisional Patent Application, Ser. No. 62/339,233, filed on 20 May 2016. The Provisional Patent Applications are hereby incorporated by reference herein in their entirety and are made a part hereof, including but not limited to those portions which specifically appear hereinafter.

STATEMENT REGARDING FEDERALLY SPONSORED RESEARCH OR DEVELOPMENT

This invention was made with government support under Contract No. DE-AC26-07NT42677 awarded by the U.S. Department of Energy. The government has certain rights in the invention.

BACKGROUND OF THE INVENTION

Field of the Invention

This invention is directed to a hydraulic fracturing system and method for enhancing an effective permeability of low permeability earth formations to increase hydrocarbon production, enhance operation efficiency by reducing fluid entry friction due to tortuosity and perforation, and to open perforations that are either unopened or not effective using traditional perforating techniques including techniques utilizing shaped explosive charges, as well as reducing entry friction in slotted pipe during multi stage hydraulic fracturing operations.

Discussion of Related Art

Hydraulic fracturing is a method of extracting hydrocarbons from earth formations in which thousands of gallons of a fracturing fluid, generally water, proppants, and other chemicals, are injected into a wellbore and a surrounding earth formation. The high pressure creates fractures in the earth formation, along which hydrocarbons, such as gas and petroleum, may flow to the wellbore and collected therefrom. However, this basic hydraulic fracturing method is unable to extract a maximum amount of hydrocarbons. Generally, after an initial fracturing operation, pumping continues to cause deepening and widening of the fissures by injection of more fluid. While it is generally desirable to open a plurality of fractures in a selected stratum, the basic process is only capable of creating a suboptimal amount of fractures. When an incipient fracture begins to open, the fracturing fluid enters this new space and the pressure in the wellbore and fractures decreases reducing the tendency to open new fractures. This phenomenon limits the results of the basic fracturing process.

Other known hydraulic fracturing processes attempt to improve the process described above by adding a hammer effect to transmit a relatively large hydraulic shock against the formation to be fractured. For example, U.S. Pat. No. 2,915,122 to Donald S. Hulse and U.S. Pat. No. 3,048,226 to E. W. Smith. Other known hydraulic fracturing processes use a series of pressure pulses to improve the typical fracturing process. For example, U.S. Pat. No. 3,602,311 to Norman F. Whitsitt and U.S. Pat. No. 3,933,205 to Othar Meade Kiel. However, these known processes generally effect only a small number fractures radiating from the wellbore and may cause damage to piping and equipment.

Other known hydraulic fracturing techniques attempt to overcome the issue of reduced pressure due to newly opened fractures by blocking the newly formed fractures to allow a return to the initial pressure to allow additional fractures to be created. These methods include using degradable and/or non-degradable ball sealers that enter newly opened perforations to restrict flow of fracturing fluid into the opened perforations, thus forcing the fracturing fluid to open new perforations and to create new fractures. Ball sealers land on the newly opened perforations until a complete ball-out is achieved, where all possible perforations are opened and then sealed with a ball. At this point, no more flow is possible and the ball sealers have to be removed by flowing the well back, or in the case of using degradable balls, a long period is needed to allow for the balls to dissolve. These techniques are not practical in long horizontal wells where 100 or more perforation clusters are used to stimulate the long horizontal well. Furthermore, the wait time for the degradable ball sealers to dissolve would render the operations uneconomical.

As such, there is a need for an improved hydraulic fracturing process that provides an increased hydrocarbon production without the shortcomings of the known processes.

SUMMARY OF THE INVENTION

It is one object of this invention to provide a system and method for providing a pressure pulse to a wellbore to improve fracturing of an earth formation to provide increased hydrocarbon production.

It is another object of this invention to provide the pressure pulse and minimizes or eliminates wear or damage to a fracturing pump and/or other fracturing equipment.

These and other benefits can be provided by an embodiment of this invention which includes one or more of a fracturing fluid storage tank, a pre-blender, a slurry-blender, a proppant storage and delivery system, a manifold, a high-pressure fracturing pump, a chemical truck, a flow line connected to a wellhead of a wellbore, a bleed-off valve and a bleed-off line connected to a pit. Alternative embodiments of this invention may be created without one or more of the listed components and may include additional components.

In a preferred embodiment, the fracturing tank supplies a primary component of a fracturing fluid and/or a fracturing slurry, each of which preferably comprise water. However, other fluids, gels and other materials may be used as the primary component of the fracturing fluids and/or fracturing slurry. The fracturing tank is connected to the pre-blender, for example, a mixing truck that also connects with a chemical truck, and mixes the water, polymer and other chemicals to make the fracturing fluid (without a proppant). The pre-blender connects to the manifold and/or the slurry-blender to provide either the fracturing fluid or the fracturing slurry to the high-pressure fracturing pumps. The slurry-blender is connected to the proppant storage and delivery system to create the fracturing slurry by mixing the fracturing fluid with the proppant. The slurry-blender connects to the manifold. The manifold receives the fracturing fluid, with or without proppant, at a low pressure from the pre-blender or the slurry-blender and distributes the fluid and/or slurry to the high-pressure fracturing pumps. The manifold then receives the fluids at a high pressure from the high-pressure fracturing pumps and directs the fluid to a ground iron leading to the wellhead and the wellbore.

The high-pressure fracturing pump pumps the fracturing fluid, with or without proppant, to the wellhead at a pump rate through a flow line. In a preferred embodiment, the flow line comprises a plurality of pipes which connect the high-pressure fracturing pumps, through a single or multiple common manifolds, to a wellhead of the wellbore. In an embodiment of this invention, the plurality of flow lines comprise at least one constant-flow flow line and at least one variable-flow flow line which includes the bleed-off valve and the bleed-off line. The constant-flow line supplies a first percentage of a flow rate supplied by the high-pressure fracturing pump to the wellhead. The flow rate of the constant-flow line preferably does not vary significantly. The variable-flow line supplies a second percentage of the flow rate supplied by the high-pressure fracturing pump to the wellhead. In a preferred embodiment, the flow rate of the variable-flow line can be varied by diverting a portion of the fracturing fluid via the bleed-off valve to a pit, tank, another wellhead and wellbore, or to any other holding device. In an alternative embodiment, the flow line may comprise a single pipe connected to the wellhead with a bleed-off line and without the constant-flow line.

In operation, a method of hydraulic fracturing stimulation according to one embodiment of this invention includes pumping the fracturing fluid, with or without the proppant, at a pump rate and injecting the fracturing fluid under pressure into the wellhead at an initial flow rate and creating small fractures in deep rock formations. As the system moves towards an equilibrium pressure with few or no new fractures being created and/or a fracture network complexity is no longer increasing, the method of this invention includes introducing a pressure pulse into the wellbore for a pulse period of time causing a temporary increase of pressure leading to opening new fractures. The pressure pulse comprises changing the initial flow rate to a primary or pulse flow rate and then to a secondary flow rate. In embodiments of this invention, the primary or pulse flow rate is less than the initial flow rate, ranging from 10% lower to nearly 100% lower, and the secondary flow rate is equal to the initial flow rate. In preferred embodiments, the primary or pulse flow rate may range from 25% to 75% lower that the initial flow rate. More preferably, the primary or pulse flow rate is 50% lower than the initial flow rate. In another embodiment of this invention, the primary or pulse flow rate is ideally dropped to zero, however a zero flow rate may not be practical because of limitations on the equipment and/or because a zero flow rate will cause proppant transport issues and may damage equipment. In alternative embodiments, the primary or pulse flow rate may be greater than the initial flow rate and/or the secondary flow rate may not equal the initial flow rate and may instead be greater than or less than the initial flow rate. In an embodiment of this invention, the pulse period of time is less than one minute. In a preferred embodiment of this invention, the pulse period of time is less than 10 seconds.

In an embodiment of the method of this invention, the pressure pulse is introduced by diverting a portion of the fracturing fluid away from the wellbore to provide a reduced flow rate to the wellbore for the pulse period of time. In this embodiment, the pump rate of the high-pressure fracturing pump remains constant so as to avoid placing additional stress on the high-pressure fracturing pump. In a preferred embodiment, the step of introducing the pressurized pulse comprises a plurality of pressurized pulses.

In an alternative embodiment, the pressure pulse is introduced by changing the pump rate of a fracturing pump from the pump rate to the pulse pump rate and back to the pump rate. Preferably, the pulse pump rate is less than the pump rate. Alternatively, the pulse pump rate is greater than the pump rate.

In another alternative embodiment, the pressure pulse includes increasing the initial flow rate to a pre-pulse or intermediate flow rate, rapidly dropping the flow rate to a primary or pulse flow rate and returning the flow rate to the pre-pulse or intermediate flow rate and repeating this cycle for a number of times before returning the flow rate to the initial flow rate. This approach may be done by increasing and decreasing the pump rate and/or by redirecting the flow of fracturing fluid to change the flow rate.

In one aspect of the subject development, a new method of hydraulic fracturing to create a number of additional open perforations in an earth formation having a total number of perforations is provided. In accordance with one embodiment, such a method involves pumping a fracturing fluid into the earth formation at a first pressure ($P_1$) and a first flow rate ($Q_1$). Subsequently, the fracturing fluid is pumped into the earth formation at a second pressure ($P_2$) and a second flow rate ($Q_2$) to introduce a change of flow rate into the earth formation for a period of time, where the second flow rate ($Q_2$) is significantly reduced as compared to the first flow rate ($Q_1$). The method further involves return pumping of the fracturing fluid into the earth formation at the first flow rate (where the flow rate on said return of the pumping is designated ($Q_R$)), and identifying a pumping pressure ($P_R$) associated with the flow rate on said return of the pumping ($Q_R$) and calculating the number of additional open perforations and a total number of open perforations in the earth formation.

In accordance with another embodiment, a method of hydraulic fracturing to create a number of additional open perforations in an earth formation is provided. Such a method involves pumping a fracturing fluid into the earth formation at a first pressure ($P_1$) and a first flow rate ($Q_1$). Followed by, pumping the fracturing fluid into the earth formation at a second pressure ($P_2$) and a second flow rate ($Q_2$) to introduce a change of flow rate into the earth formation for a period of time, where the second flow rate ($Q_2$) is significantly reduced as compared to the first flow rate ($Q_1$). Subsequently, return pumping of the fracturing fluid into the earth formation at the first flow rate (where the flow rate on said return of the pumping is designated ($Q_R$)) and identifying a pumping pressure ($P_R$) associated with the flow rate on said return of the pumping ($Q_R$). The pumping pressure associated with return to the first flow rate ($P_R$) is compared with the first pressure ($P_1$) and at least one fracturing fluid operation parameter selected from the group of flow rate, duration, and frequency is correspondingly adjusted.

A method of hydraulic fracturing to create a number of additional open perforations in an earth formation, in accordance with another embodiment involves:

a. pumping a fracturing fluid into the earth formation at a first pressure ($P_1$) and a first flow rate ($Q_1$);

b. pumping the fracturing fluid into the earth formation at a second pressure ($P_2$) and a second flow rate ($Q_2$) to introduce a change of flow rate into the earth formation for a period of time, where the second flow rate ($Q_2$) is significantly reduced as compared to the first flow rate ($Q_1$);

c. return pumping of the fracturing fluid into the earth formation at the first flow rate (where the flow rate on said return of the pumping is designated ($Q_R$)) and identifying a pumping pressure ($P_R$) associated with return to the first flow rate ($Q_R$); and d. comparing the pumping pressure associated with return to the first flow rate ($P_R$) with the first pressure ($P_1$) to determine one or more of: number of open perforations originally in the earth formation and the number of additional open perforations resulting from the hydraulic fracturing.

The invention provides an improved hydraulic fracturing process that provides increased hydrocarbon production without the shortcomings of known processes.

BRIEF DESCRIPTION OF THE DRAWINGS

These and other objects and features of this invention will be better understood from the following detailed description taken in conjunction with the drawings, wherein.

DESCRIPTION OF PREFERRED EMBODIMENTS

Figure 1:
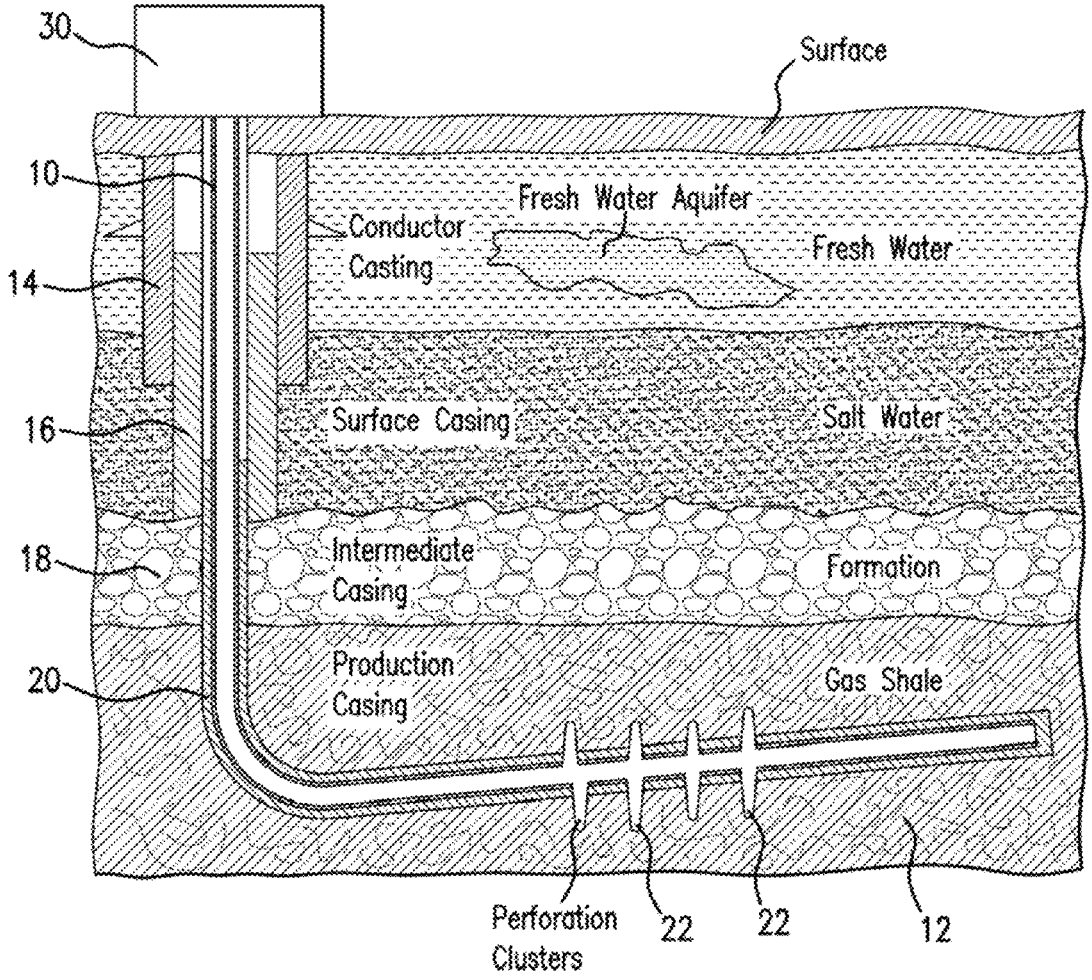
FIG. 1 is a schematic diagram of a wellbore.

Hydraulic fracturing stimulation is a method of enhancing an effective permeability of a low permeability formation by extending a wellbore in the formation and creating propped fractures that enable hydrocarbon production from vast amounts of reservoir and channeling the hydrocarbons back to the wellbore from which the hydraulic fractures emanate. FIG. 1 shows a schematic view of a horizontal wellbore 10 for a fracturing operation. In this representation, the wellbore 10 extends vertically downward into the earth until reaching a target reservoir 12 (e.g. gas shale) where the wellbore 10 extends generally horizontal at a slight upward angle. It should be noted that the wellbore 10 is representative and the system and method of this invention be used with any type of wellbore that is necessary to access an earth formation. Furthermore, the method of this invention will be described in connection with gas shale however, it should be understood that the method may also be used with tight gas, tight oil, coal seam gas and other earth formations requiring hydraulic fracture stimulation including but not limited to geothermal reservoirs.

In the embodiment of FIG. 1, the wellbore 10 includes a conductor casing 14, a surface casing 16, an intermediate casing 18 and a production casing 20. However, it should be understood that the method of this invention is not limited to the wellbore 10 of FIG. 1 and may be used with other types of wellbore configurations, including fracture stimulation of vertical or slant wellbores. FIG. 1 shows the wellbore extending into the earth including a surface layer, a salt water layer, a formation layer, and the gas shale layer. However, it should be understood that the system of this invention is not limited to this geologic formation and may be used with other geologic formations. It should also be understood, that the system and method of this invention may be used with a subterranean extraction process including, but not limited to, enhanced geothermal systems.

In a preferred embodiment of this invention, the wellbore 10 further includes a plurality of perforation clusters 22. The industry standard is to perforate multiple sections of the horizontal or vertical wellbore usually in 3 or 4 short sections called perforation clusters, spaced a short distance apart. For example, if a 200 foot section of the reservoir is to be fracture stimulated, an approach would be to perforate four, 1 foot sections of the wellbore spaced 50 feet apart, resulting in 4 clusters of perforations that should create 4 or more individual fractures. However, any number of perforation clusters and/or spacing may be used. For example, long horizontal wells may include 120 or more perforation clusters.

A typical fracture treatment is designed to be pumped at a constant flow rate to a wellhead and a wellbore, where increasing pressure in the wellbore fractures the earth formation. The method of this invention involves changing the fracturing flow rate rapidly to impart a pressure pulse that can open unopened perforations by exceeding a perforation breakdown pressure.

In an embodiment of this invention, the pressure pulse is imparted by rapidly shutting off a fracturing pump 42 (FIG. 4) and turning the fracturing pump 42 back on. Alternatively, the pressure pulse may be imparted by changing by rapidly increasing or decreasing a pressure of a pump rate of the fracturing pump 42. These methods are preferably conducted with fracturing fluid which does not include proppant, however; the methods may also be conducted with the fracturing fluid with proppant, also known as a fracturing slurry.

Figure 2:
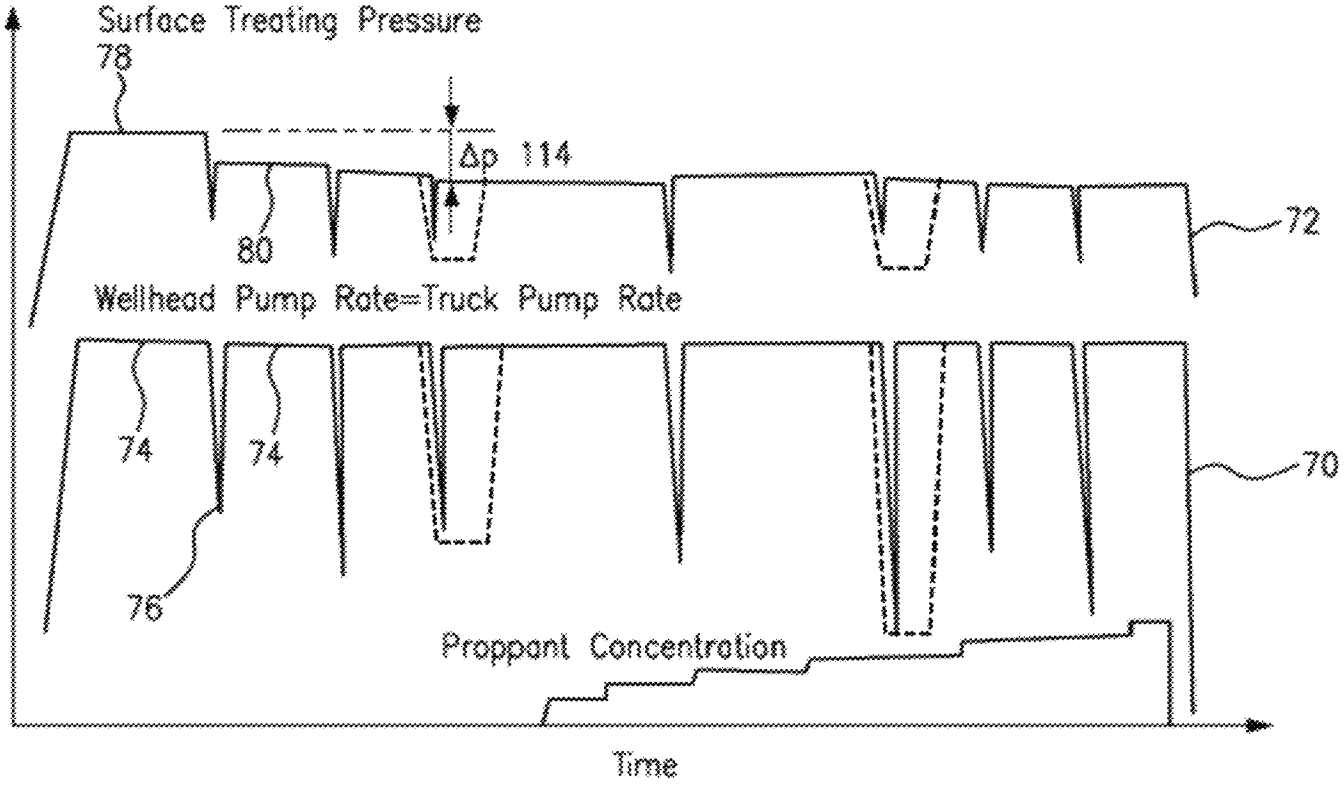
FIG. 2 is a graph showing a pump rate and a surface treating pressure of a method of hydraulic fracturing according to an embodiment of this invention.

FIG. 2 shows a graph showing an embodiment of this invention where a pump rate 70 is varied to impart a pressure pulse to the wellhead to cause a change (ΔP) in a surface treating pressure 72. In this embodiment, the pump rate 70 starts at an initial pump rate 74 and rapidly dropped to primary or pulse pump rate 76 before returning to the initial pump rate 74, this cycle is preferably repeated a plurality of times. As shown in the upper plot, the surface treating pressure 72 increases until it reaches a plateau pressure 78. When the primary or pulse pump rate 76 is introduced, the surface treating pressure 72 follows by dropping in pressure and rapidly increasing to a second plateau pressure 80. The second plateau pressure 80 is at lower pressure than the plateau pressure 78. This change in pressure (delta P (ΔP)) shows the pressure drop in the surface treating pressure 72 is associated with opening of additional perforations and/or fractures in the formation. In the embodiment of FIG. 2, the method of this invention starts without proppant in the fracturing fluid. As the method of this embodiment proceeds, a proppant concentration 82 in the fracturing fluid is increased.

FIG. 2 also shows, in dashed line form, an embodiment wherein one or more drop or decrease in pump rate and associated drop or decrease in the surface treating pressure is for relatively extended period of time.

Figure 3:
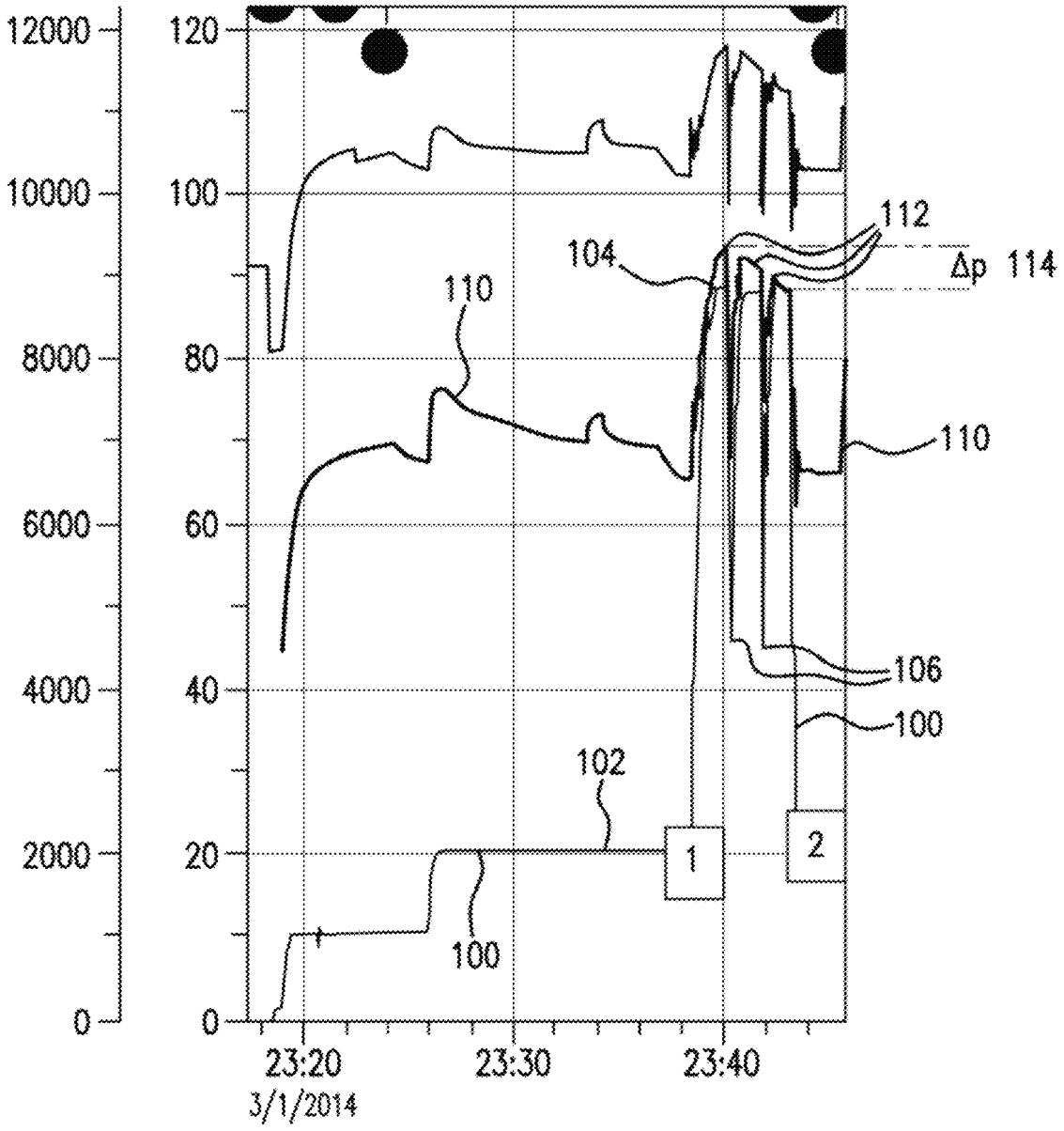
FIG. 3 is a graph showing a wellhead pump rate and a surface treating pressure of a method of hydraulic fracturing according to an embodiment of this invention.

In another embodiment as shown in FIG. 3, the method includes changing a fracturing pump rate 100 from 90 barrels per minute (bpm) to approximately 45 bpm, and then rapidly bringing the rate back to 90 bpm. Note that the rates mentioned here are meant as examples of sudden substantial rate decrease for creating a pressure pulse and are not intended to be limiting. The pumping of fracturing fluid or slurry into the wellhead causes a surface treating pressure 110 increase in the earth formation. In FIG. 3, the pump rate 100 is increased until it reaches an initial pump rate 102, approximately 20 bpm. Beginning at point 1, the pump rate 100 is increased to a pre-pulse or intermediate pump rate 104, approximately 90 bpm, and rapidly dropped to a primary or pulse pump rate 106, approximately 45 bpm, and returned to the pre-pulse or intermediate pump rate 104, approximately 90 bpm. In this embodiment, the pulse is repeated three times before returning to the initial pump rate 102 at point 2. The pump rate 100 causes a treating pressure 110 in the wellbore. This embodiment was implemented to induce three pressure impulses 112, however any number of pressure impulses may be used. In each successive pulse, when the pump rate 106 was brought back up to the pre-pulse or intermediate pump rate 104, the treating pressure 110, the pressure impulse 112, was lower, indicating that there was less friction in the system. This could only happen if additional flow channels have been opened, thus implying that previously unopened perforations have been opened or new fractures extending from perforations have been created. Delta P (ΔP) 114 shows the pressure drop in the treating pressure 110 of each the pressure impulses 112 associated with opening of additional perforations and/or fractures in this embodiment. The significance of this is that the method of this invention opens new perforations without physical flow diverters such as ball sealers or frac balls and doesn't cost anything extra to execute. However, strain is placed on the fracturing pumps while performing this kind of rapid pump rate change.

Figure 4:
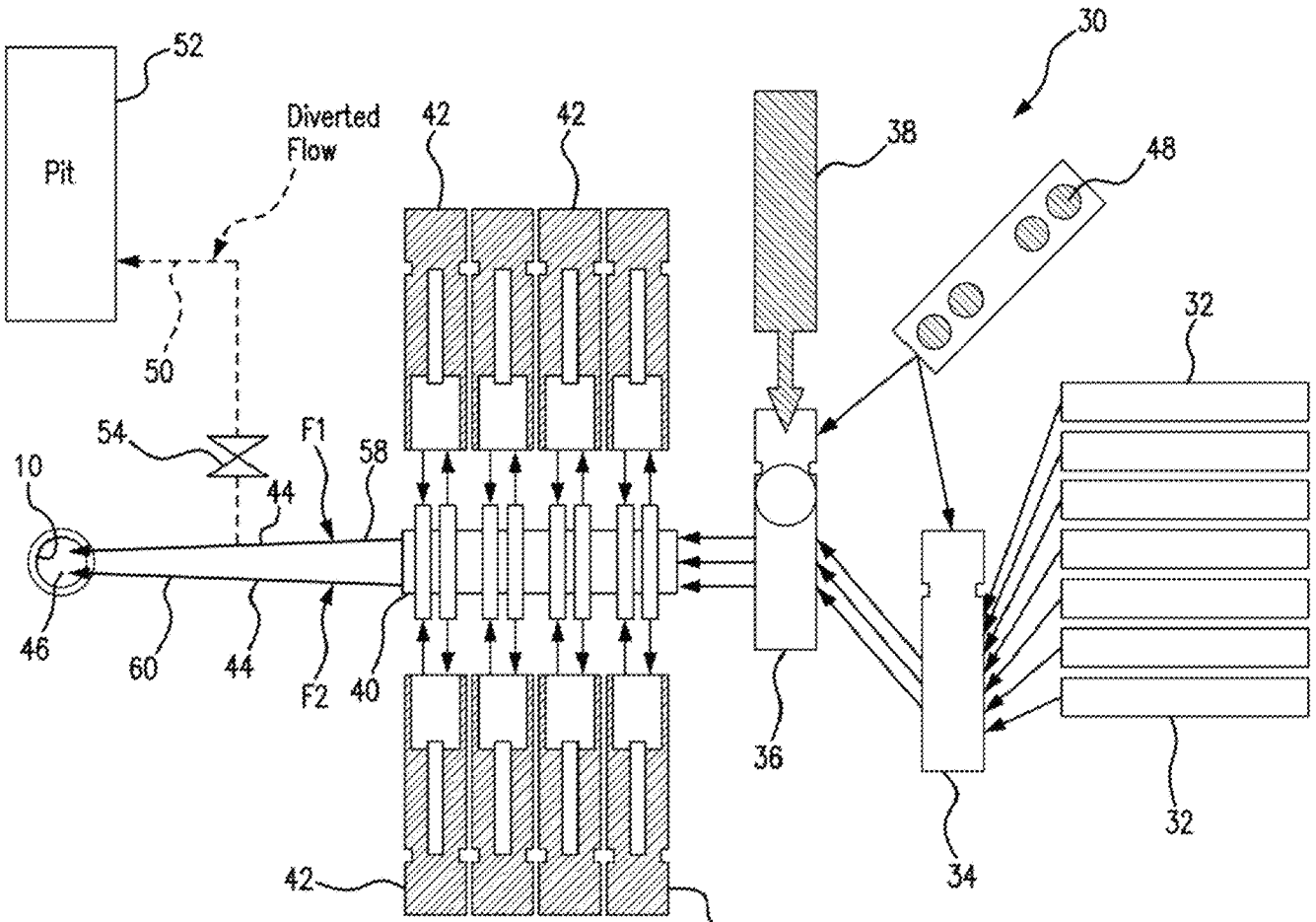
FIG. 4 is a schematic diagram of a system for hydraulic fracturing according to an embodiment of this invention.

In a preferred embodiment of this invention, rather than rapidly increasing and/or decreasing the pump rate of the fracturing pumps or in addition to changing the pump rate, a portion of the fracturing fluid, with or without proppant, is diverted away from the wellhead, changing the flow rate, in order to provide a pressure pulse to the wellbore 10. FIG. 4 shows a schematic representation of an embodiment of an overall system layout 30 of this invention for providing a pressure pulse to the wellbore 10 with or without changing the pump rate. The system 30 of this embodiment preferably includes a fracturing tank 32, generally a water tank, to store the water and/or other fluid that will comprise a portion of the fracturing fluid. The system 30 preferably also includes a pre-blender 34, preferably a mixing truck that mixes the water or other fluid from the fracturing tank with other components of the fracturing fluid such as polymers and other chemicals to make the fracturing fluid. At this point, the fracturing fluid preferably does not include a proppant. The system of this invention further includes a slurry-blender 36 that mixes the fracturing fluid with the proppant and/or other chemicals to create a fracturing slurry. The proppant is stored in a proppant storage and delivery system 38 prior to mixing in the slurry-blender 36. The system of this invention preferably further includes a manifold 40 that receives a fracturing slurry from the slurry-blender at a low pressure and distributes to a high-pressure fracturing pump 42. The high-pressure fracturing pump 42 returns the fracturing fluid, with or without the proppant, to the manifold 40 at a high-pressure and to a flow line 44 to a wellhead 46 connected to the wellbore 10. In a preferred embodiment, the system 30 further includes a chemical truck 48 which supplies chemicals to at least one of the pre-blender 34 and the slurry-blender 36.

Figure 5:
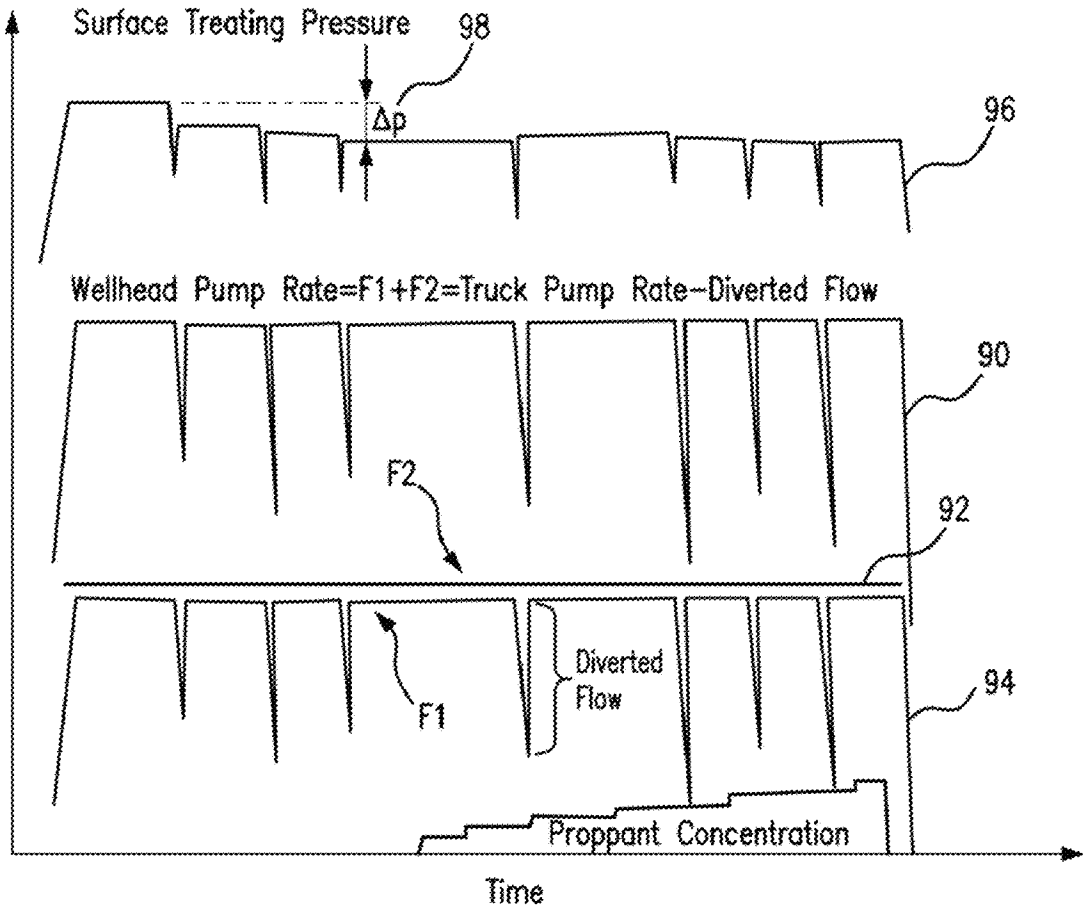
FIG. 5 is a graph showing a surface treating pressure and a wellhead pump rate where a portion of a total pump flow is diverted according to another embodiment of this invention.

In a preferred embodiment, the system of this invention includes a plurality of flow to lines 44 to the wellhead 46. Preferably, at least one of the flow lines 44 is a variable-flow flow line 58 that is connected to a bleed-off line 50 connected to a pit 52 or some other type of storage, open or enclosed, or to another wellhead. While at least another one of the flow lines 44 is a constant rate flow line 60. In operation, the high-pressure fracturing pump 42 supplies the fracturing fluid or the initial fracturing fluid to the flow lines 44 at a constant pressure and the constant-flow line 60 supplies a first percentage of the flow rate supplied by the high-pressure fracturing pump to the wellbore and the variable-flow line 58 supplies a second percentage of the flow rate supplied by the high-pressure fracturing pump. In a preferred embodiment, the flow rate supplied by the constant-flow line 60 does not change during the pressure pulse, while the flow rate supplied by the variable-flow line 58 changes during the pressure pulse. A bleed-off valve 54 in the bleed-off line 50 connected to the variable-flow line 58 can be opened and closed to divert a portion of the fluid from the wellhead 46 to provide the pressure pulse to the wellhead 46. For example in FIG. 5, two flow lines are used to supply a wellhead pump rate 90, for example a total flow rate of 90 barrels per minute (bpm), to the wellhead 46. In this embodiment, the constant-flow line 60 and the variable-flow line 58 each supply a percentage of the total flow (F1+F2) for example the constant flow line supplies a constant flow rate 92 of 50% of the total flow, equaling 45 bpm, and the variable flow line supplies a variable flow rate 94 of 50% of the total flow, equaling 45 bpm. A pressure pulse is induced by allowing the constant-flow line F2 to continue supplying the 45 bpm and redirecting the flow F1 of the variable-flow line 58 away from the wellhead 46 for a short period of time into the pit 52. For example, the short period of time may range from 1 minute to 1 second. Preferably, the short period of time equals 10 seconds. Alternatively, any period of time may be used. By redirecting the flow for the short amount of time, the method simulates the case where some of the pumps are being shut down (one half of the pumps in the example case), inducing a pressure impulse in a surface treating pressure 96. As shown in FIG. 5, when the bleed-off valve was closed and the wellhead pump rate was returned to the truck pump rate, the surface treating pressure 96 is lower than the initial treating pressure, Delta P (ΔP) 98, indicating that there was less friction in the system. This could only happen if additional flow channels have been opened, thus implying that previously unopened perforations have been opened or new fractures extending from perforations have been created. The significance of this is that the method of this invention opens new perforations without physical flow diverters such as ball sealers or frac balls and does not require the truck pump rate to change. Please note the flow rates and times in the above example are exemplary and may be varied depending on the requirements of the wellbore and the earth formation.

In the embodiment of FIG. 5, the method of this invention starts without proppant in the fracturing fluid. As the method of this embodiment proceeds, a proppant concentration 82 in the fracturing fluid is increased. Alternatively, the entire process may be conducted with or without the proppant.

In an alternative embodiment, one or more of the flow lines 44 may include a valve, not shown, that can be opened and closed to restrict a flow of fluid to the wellbore 10 to provide the pressure pulse.

Figure 6:
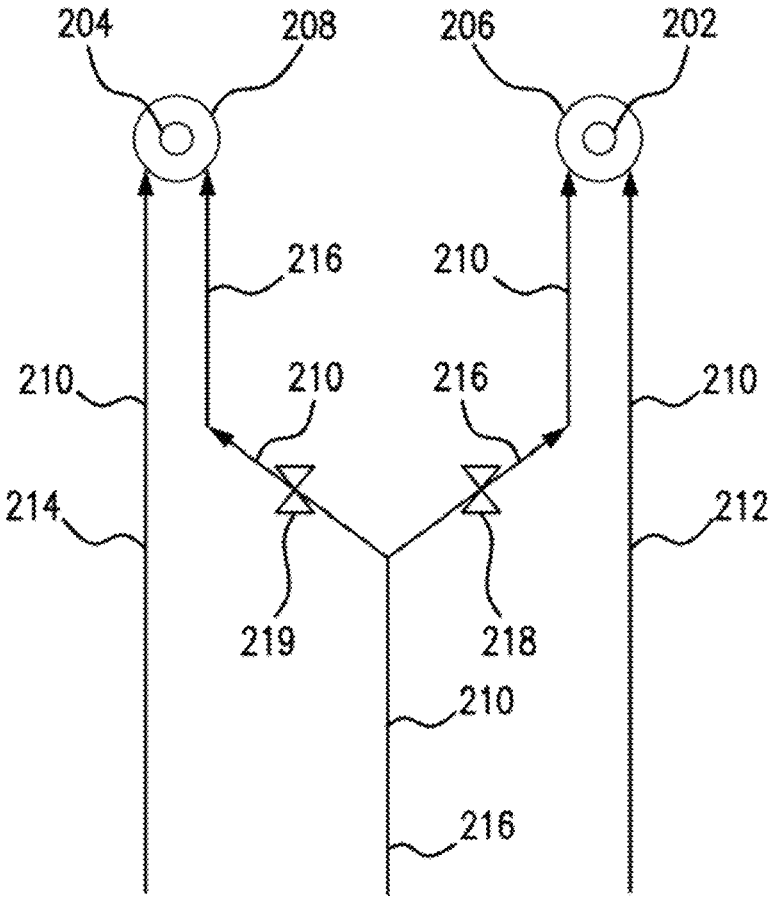
FIG. 6 is a schematic diagram of a portion of a system for hydraulic fracturing according to an alternative embodiment of this invention.
Figure 7:
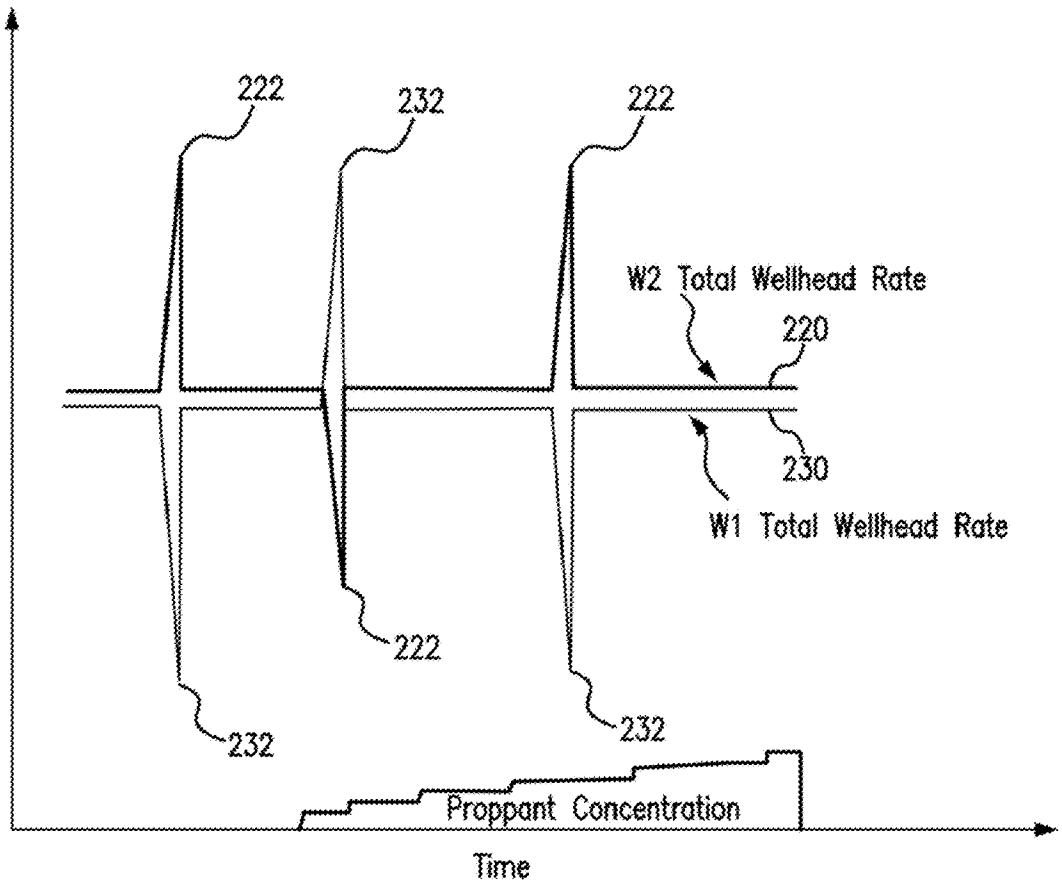
FIG. 7 is a graph showing a first total flow rate to a first wellhead and a second total flow rate to a second wellhead in another embodiment of this invention.

In another embodiment of this invention, partially shown in FIG. 6, the system includes a pair of wellheads 202, 204 each connected to a wellbore 206, 208. A plurality of flow lines 210 connect to the wellheads 202, 204. In this embodiment, each of the wellheads include a constant rate flow line 212, 214 and a diverter line 216 which is connected to both of the wellheads 202, 204. Each of the lines 212, 214, and 216 preferably connects to a system, not shown, for providing a pressure flow rate to the wellheads 202, 204, such as the system shown in FIG. 4. In the embodiment of FIG. 6, each of the wellheads 202, 204 includes a separate constant flow rate line 212, 214 and the wellheads 202, 204 share the diverter line 216 with one or more valves 218, 219. In operation, the high-pressure fracturing pump, not shown, supplies the fracturing fluid or the fracturing slurry to the flow lines 210 at a constant flow rate. A first percentage of the flow rate passes through the first constant rate flow line 212, a second percentage of the flow rate passes through the second constant flow rate line 2014, and a third percentage of the flow rate passes the diverter line 216. In a preferred embodiment, the flow rate supplied by each of the constant rate flow lines 212, 214 does not change during the pressure pulse. While the flow rate supplied by the diverter line 216 is diverted to each of the wellheads 202, 204 during the pressure pulse. For example in FIG. 7, the high-pressure fracturing pump provides a first total flow rate 220 to the first wellhead 202 and a second total flow rate 230 to the second wellhead 204. Initially, both valves 218 are open allowing the third percentage of the flow rate to be provided to both of the wellheads 202, 204. A pressure pulse 222, 232 is induced by closing one of the valves 219, increasing the total flow rate 220 to the first wellhead 202 and decreasing the total flow rate 230 to the second wellhead 204 for a short period of time. For example, the short period of time may range from 1 minute to 1 second. Preferably, the short period of time equals 10 seconds. Alternatively, any period of time may be used. The process is then repeated by closing the valve 218, increasing the total flow rate 230 to the second wellhead 204 and decreasing the total flow rate 220 to the first wellhead 202 for a short period of time. With this system, the fracturing fluid is conserved and not diverted to a pit.

In operation, one or more methods of this invention impart a flow rate change in the fracturing fluid flow that is preferably at least 10% below an original wellhead treatment rate, all the way to 0 (zero) rate. In a preferred embodiment, the flow rate change ranges from 25% to 75% lower and more preferably changes by 50%. Furthermore, the pressure impulse has a duration ranging from 1 minute to 1 second. Alternatively, the pressure impulses can be induced by increasing the flow rate change.

Multiple rate reductions can be executed during any part of the fracturing process. In a preferred embodiment, the method of this invention the rate reduction, pressure pulse, is least risky and potentially most effective in a pad stage, i.e. a stage of providing the fracturing fluid without the proppant. Performing these rapid, large flow rate variations and/or pump rate variations, especially reductions, in the pad stage presents the least amount of risk because there is no proppant in the equipment, the wellbore and the formation that can settle out or bridge during rate reductions as rate reductions decrease the fluid velocity and in turn decrease the fluids' proppant transport capabilities. The rate variations are also potentially more effective in the pad stage as they open new perforations and then the proppant-less fluid is able to extend the newly created fracture before proppant has a chance to bridge off and potentially close it.

The present development is described in further detail in connection with the following examples which illustrate or simulate various aspects involved in or with the practice of the invention. It is to be understood that all changes that come within the spirit of the invention are desired to be protected and thus the invention is not to be construed as limited by these examples.

EXAMPLES

Experimentation with variable rate fracturing in shale resources has shown to increase production when comparing fracture stages that have been executed with rapid rate fluctuations (variable rate fracturing) and stages without rapid rate fluctuations. Although production rate, or change in rate, is a reliable indicator of technology impact, it does not necessarily allow for optimization of the technology or future improvements. As will be appreciated by those skilled in the art and guided by the teachings herein provided, production by itself does not lead to an understating of the basic physical processes that drive the production increase.

Below is a discussion of a series of ongoing efforts to better understand the variable rate fracturing technique on a basic-physics level as well as ongoing field implementation, development of software, analysis techniques, correlations, etc., for future optimization.

Calculation of the number of open perforations during hydraulic fracturing treatments generally involves use of fluid flow equations of some sort. In such processing, since the frac fluid is typically pumped downhole and through previously created perforations into the formation, fluid flow through an orifice can be used to model this problem. In its simplest form, for subsonic fluid flow, the incompressible Bernoulli's equation can be used to describe the flow through an orifice with intrinsic assumptions of steady state, incompressible flow with negligible viscous forces acting along the tubing surface.

$$\Delta P = \tfrac{1}{2}\rho V_2^2 - \tfrac{1}{2}\rho V_1^2 \quad (1)$$

Equation of continuity can be used to convert the model into volumetric form. A discharge coefficient is used to account for viscosity and turbulence effects and a flow coefficient is used to account for uncertainty at downstream end of the flow model.

$$Q = CA\sqrt{\frac{2\Delta P}{\rho}} \quad (2)$$

Rearranging for the required ΔP across "n" perforations for flow at given rate, $$\Delta P_{perf} = \frac{C_{MF}\rho Q^2}{n^2 D^4 C^2} \text{ or } \Delta P_{perf} = k_{perf} Q^2 \text{ where } k_{perf} = \frac{C_{MF}\rho}{n^2 D^4 C^2} \quad (3)$$

Where $C_{MF}$ gives the multiplier to convert to any desirable units of measurement as required and D denotes the diameter of the open perforations (generally <1"). The discharge coefficient "C" varies significantly with changes in the cross-sectional area of the flow conduits as well as the flow conditions (Reynold's number). For limited entry treatment calculations, values of ~0.6 can be used before treatment (new perforations) and 0.85 post treatment (highly eroded perforations). Similarly, a tortuosity pressure drop can also be accounted for by:

$$\Delta P_{tort} = k_{tort} Q^{\alpha} \quad (4)$$

Traditionally, a step-down test has been employed to identify open perforations by matching the observed pressure drop after each drop in flow rate with the theoretical pressure drop obtained from the two models above. The observed pressure drop should match the sum of the pressure drops across perforations as well as the drop due to fluid tortuosity. With such testing, multiple rate drops are needed in order to fit for all of the unknowns and to get reasonably accurate predictions. In practice, a step-down test can be performed as part of the shut-in procedure at the beginning or end of treatment as required. In standard step-down testing, a fluid of known properties is injected into the formation at a rate that is high enough to initiate a fracture. Once steady rate of injection is achieved, the injection rate is reduced in a step wise fashion before the final shut-in of the well. The pressure responses due to rate changes are primarily a result of perforation friction as well as tortuosity. Also, since it takes some finite period of time for the pressure response to stabilize after each rate drop, data points for calculation need to be carefully selected. Without careful control over the testing parameters, the results could include significant errors. The analysis of this data involves matching the pressure loss models highlighted above with the actual pressure vs. rate data observed during controlled step-down tests.

The number of open perforations is calculated by minimizing the error between all actual pressure-rate observations and theoretical pressure calculations for corresponding rates from model defined earlier, i.e., $$\Delta P_{calc} = \Delta P_{perf} + \Delta P_{tort} \quad (5)$$

$$n : \min_{i=1:N} (\Delta P^i_{calc} - \Delta P^i_{obs}) \quad (6)$$

Thus, the result of such analysis is based on minimized error between the two values for each observation (each step-down in rate) computed by taking all step-down observations (N in total) into account.

In accordance with a preferred aspect of the subject development, a method or technique to evaluate the effectiveness of variable rate fracturing such as herein described is provided and can be implemented as a means to increase number of open perforations before proppant pumping in initiated. The aim is to calculate the additional perforations opened while applying variable rate fracturing without making any significant changes in the treatment design such as explicit inclusion of step-down tests. As further detailed below, this not only helps in understanding the effectiveness of rate fluctuations in opening additional perforations but also helps with selection and design of variable rate fracturing processing and parameters including, for example, for variable rate fracturing, parameters such as flow rate (e.g., magnitude of change and duration) as well as frequency (for example, such as measured in terms of the period of time between the endings of successive flow rate variations).

Calculation of Additional Perforations

In accordance with one aspect of the subject development, a method or technique to determine or calculate the number of additional perforations that open as a result or while applying the variable or pulse rate fluctuations during treatments as part of the hydraulic fracturing process is provided.

Figure 8:
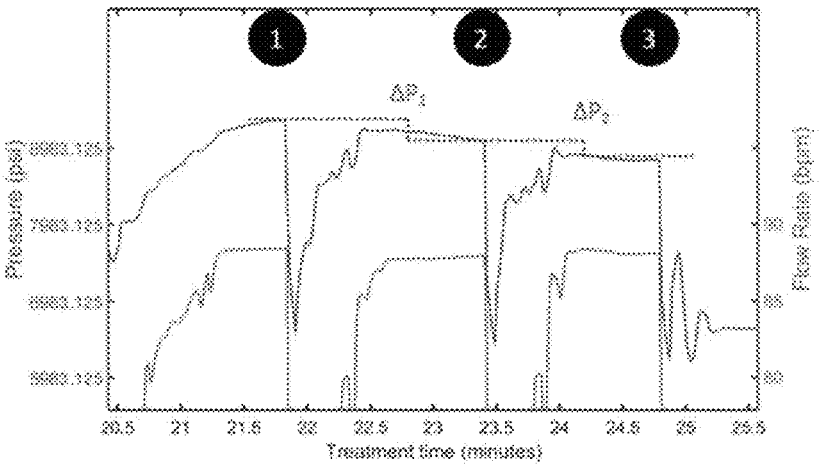
FIG. 8 is a graph showing a treatment pressure and a wellhead pump rate for a rate fluctuation introduction in accordance with one embodiment of this invention.

Since in accordance with one aspect of the subject development, variable or pulse rate fluctuations involve a drop in pressure for a period of time with a corresponding drop in flow rate, followed by a returning of the flow rate back up to the level prior to rate drop, observed changes in the pressure observed pre- and post-said rate drop can be attributed to opening of new perforations and higher cumulative flow throughput for the set of perforations, i.e., stage being completed. This assumes that impact of other factors such as changes in tortuosity, unsteady state conditions, flow rate mismatch, etc. are minimized. FIG. 8 shows an example where the distinctive change in pressure after instantaneous rate drop during variable rate fracturing when compared to the pressure before the introduction of the variance in rate.

FIG. 8 shows a representative stage completion data subset highlighting how the variable rate fracturing design produces drops in treatment pressure. Actual field tests indicate pressure drops ranging in 100's of psi. Since the pre-rate variation and post-rate variation steady state flow rates are maintained the same (within a narrow error band of ±2 bpm), the effect on pressure drop due to tortuosity effects should also remain similar unless there is significant difference in said flow rates. Thus, in accordance with one preferred embodiment, it is critical that the new flow rate achieved after each introduced rate variation as per design remains within a narrow range of what the original steady state flow rate was. This also implies that the observed ΔP after each rate drop is predominantly a function of changes in the perforation friction.

Based on the original equation for pressure drop across perforations, the observed pressure drops (see FIG. 8) can be fitted to the flow model to get the following relations:

$$r_1 = \frac{C_c Q}{D^2 k}\sqrt{\frac{\rho}{P_0}}, \quad r_2 = \frac{C_c Q}{D^2 k}\sqrt{\frac{\rho}{P_0 - \Delta P_1}}, \quad r_3 = \frac{C_c Q}{D^2 k}\sqrt{\frac{\rho}{P_0 - \Delta P_1 - \Delta P_2}}, \tag{7}$$

where, $P_o$ is the initial steady state pressure before any of the rate fluctuations are introduced;

"r" is the number of open perforations at any point under evaluation;

$\Delta P_1$ & $\Delta P_2$ are the pressure drops (see FIG. 8); and $C_C$ is a constant which is dependent on the units being used for evaluation.

Based on these individual relations, two characteristic functions can be obtained which can be used to predict the number of perforations and more importantly, additional perforations being open at the three points of interest.

$$\frac{r_2^2 - r_1^2}{r_2^2 r_1^2} = \frac{D^4 k^2 \Delta P_1}{C_c^2 Q^2 \rho} \text{ and } \frac{r_3^2 - r_2^2}{r_3^2 r_2^2} = \frac{D^4 k^2 \Delta P_2}{C_c^2 Q^2 \rho} \tag{8}$$

Now there are two non-linear equations and three unknowns to resolve (Note in other possible implementations, there can be a higher number of rate pulses which will create more equations but the number of unknowns will always be one more than the number of equations). However, the maximum possible number of perforations is limited by the number of perforation shots for the particular stage in question as per the completion design. For this case, the system of equations is solved by minimizing the error for all possible combinations of "r" between the calculated $\Delta P_1$ & $\Delta P_2$ and the actual observations using a least squares approach. This can be done individually (i.e., for each rate drop separately) or for all systems based on number of rate pulses being analyzed. Thus the minimization function becomes:

$$f(r_i, r_{i+1}) = \min_i \left\{\frac{r_{i+1}^2 - r_i^2}{r_{i+1}^2 r_i^2}\right\} - \left\{\frac{D^4 k^2 \Delta P_i}{C_c^2 Q^2 \rho}\right\} \tag{9}$$

The function, when minimized for all values of "r" at once depending on the number of rate pulses introduced, can be represented as:

$$f(r_{i=1:final}) = \min \sum_{i=1}^{final} \left\{\frac{r_{i+1}^2 - r_i^2}{r_{i+1}^2 r_i^2}\right\} - \left\{\frac{D^4 k^2 \Delta P_i}{C_c^2 Q^2 \rho}\right\} \tag{10}$$

$$r_1 \le r_2 \le r_3 \le \cdots \le r_{final} \tag{11}$$

Where $r_{final}$ is the final observed number of open perforation at the end of the last rate fluctuation. Since the uncertainty associated with each point being considered for analysis can differ significantly depending on the differences in flow rate (though small) as well as errors in identified steady state pressure measurements from the post-rate pulse pressure data and since the chances of such uncertainty are significant, in accordance with one embodiment, each equation of the system is solved individually and in sequence starting with the first rate pulse and limit the value of parameter "r" for previous rate pulse in subsequent equations of the system being solved. At the same time, a composite fit is calculated where data from all of the rate drops are solved together and use the mismatch between the open perforations observed between the two calculations to predict how uncertain the resulting estimates are. In order to constrain the solution for "r", the uncertainty measure is minimized. Uncertainty for each evaluation of "r" for open perforations is computed as:

$$r_i^{uncertainty} = \frac{r_i^{singular} - r_i^{composite}}{r_{maximum}} \tag{12}$$

i.e., the uncertainty is higher as the predicted open perforations calculated individually ($r_i^{singular}$) and from all of the rate drops together ($r_i^{composite}$) diverges significantly. The range of uncertainty function is between 0 & 1 (since it is scaled to maximum possible perforations, i.e., $r_{maximum}$, based on perforation shots). Thus the final solution for "r" minimizes the uncertainty for r as:

$$r: \min_{i=1:total} f(r_i) \;\&\; \min \sum_{i=1}^{total} r_i^{uncertainty} \tag{13}$$

Based on testing, the following two important observations are here made with respect to the evaluated uncertainty:

Firstly, the uncertainty generally increased as the processing progressed from the first rate variation or pulse to subsequent rate variations or pulses. This is attributed to any error from the first calculation or evaluation being "carried" to the next or subsequent calculation or evaluation since the number of open perforations prior to any rate fluctuation is fixed by what was observed at the end of the previous rate fluctuation. However, under certain situations where the subsequent rate pulses may be "cleaner" with a well-defined treatment compared to the first rate variation or pulse, the uncertainty for subsequent rate variations or pulses can be lower. Secondly, the number of open perforations has been found to be generally higher post rate variation or pulse compared to the number of open perforations prior to the introduction of the said rate variation or pulse. This results in solution to be below the "r-prior=r-posterior" identity. Also, there are multiple local minima highlighting multiple possible solutions but the optimal solutions is chosen based on the secondary constraint, i.e., minimizing the cumulative uncertainty of all evaluated "r" (eq. 13).

In accordance with one preferred embodiment, results with minimum possible model uncertainties are utilized. To that end, as a first step, a subjective classification is made for both "usable" and "unusable" rate pulse experiments depending on data quality. It is noted that those deemed "unusable" may still have opened additional perforations and created additional flow pathways but accurate modeling for perforations is difficult and error-prone. Following, in order to validate that the subjective classification is similar to what is observed from the calculations, the calculated distribution for uncertainties was mapped and a distinct difference with those stages identified as usable showing lower uncertainties. The distribution of the uncertainties suggests that quantified uncertainty from such analysis can also be used as a fairly reliable indicator of "usability".

Since, as discussed above, traditional rate step-down tests can be used to estimate number of open perforations as long as the analysis is carefully conducted, such experiments when introduced before and after introduction of rate variations or pulses, in accordance with the subject development, can be used to validate the above-described technique to calculate additional open perforations from pressure drop following rate variations or pulses alone. In practice under actual operational conditions in the field, step-down tests are generally not conducted due to time constraints but more importantly, difficulty in controlling such experiments at significantly high initial flow rates. Examples of issues that can arise in such field practice include lack of pressure stabilization and inadequate fluid volumes to incorporate such experiments without prior planning. With the subject approach, such step-down tests are made redundant and data which gets generated naturally as part of subject fracturing technique can be directly used for diagnostics.

Data from rate step-down tests introduced before and after treatment per the subject development can be used to validate results observed from analysis of data from pressure drop post pulse fracturing technique.

Based on the modeled open perforations, for some stages, the introduction of variable rate pulses was more effective in opening new perforations compared to others. This real time diagnostic tool can be useful in designing rate pulses which are the basis of variable rate fracturing. As an example, if adequate fluid is available for flexible pad volumes, more rate fluctuations, higher $\Delta Q$'s, i.e., rate drops, etc. can be tried out before actual proppant pumping and fracture development begins. To decide on when to cease additional fluctuations, number of open perforations can be calculated in real time.

Finally, to see the overall effect of variable rate pulse fracturing on the number of perforations opened during typical treatments, the distribution of additional open perforations before and after treatment with variable rate pulse fracturing and without can be compared. For example, in one trial in which the stages where variable rate fracturing was used, the average number of additional open perforations before and after treatment was found to be 14 [6 stages]. For the stages with normal completion (i.e., did not use variable rate pulses before treatment), the average number of additional open perforations was found to be 7 [5 stages].

It is important to note that not all additional open perforations will accept or take in fluid and proppant during treatment. Completion diagnostics using a fiber deployed in a wellbore have shown the perforation clusters close to the heel and those close to the toe behave differently in terms of flow throughput. Thus a 100% increase in additional open perforations will not necessarily lead to a commensurate 100% increase in productivity from these stages. However, some increase may occur depending on which perforation clusters are impacted due to the introduction of variable rate pulses. In at least one trial, there was no significant difference between the first and the second rate drop as far as opening of additional perforations was concerned. In some cases, the first pulse seems to create more openings, for some cases it is the second rate pulse while for other cases both seem to create similar number of additional opening of perforations.

In view of the findings that not all of the perforations accept or take in fluid and that additional perforations can be opened using variable rate fracturing before proppant is introduced into the formation, alternative schemes are proposed to design parameters for variable rate fracturing during treatment.

Scheme A: Introducing step-down tests before and/or after variable rate fluctuations and using initial estimate of open perforations constrain estimation of perforation openings and/or identify perforation opening behavior.

Figure 9:
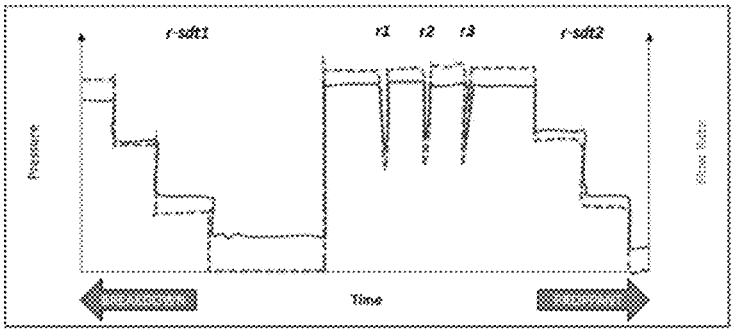
FIG. 9 is a schematic showing of a graph showing a treatment pressure and a wellhead pump rate for a variable rate fluctuation workflow design in accordance with one embodiment of this invention.
Figure 10:
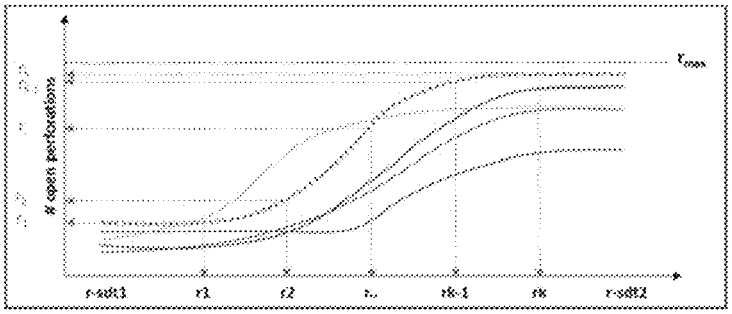
FIG. 10 is a graph showing of a workforce to design variable rate fluctuations for optimizing perforation opening in accordance with one embodiment of the subject development.
Figure 11:
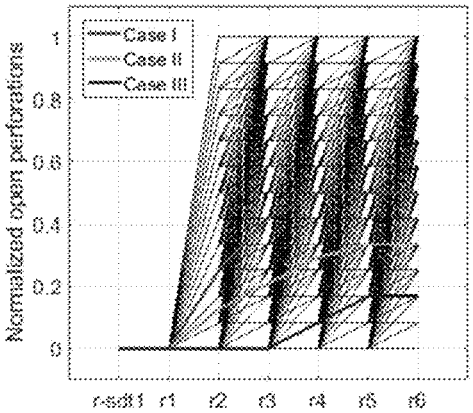
FIG. 11 is a graphical presentation of perforation opening "synthetic curves" and three potential scenarios in terms of opening of additional perforations due to introduced rate fluctuations "r".

If multiple experiments were conducted to identify the variation in number of open perforations as a result of variable rate fracturing and a significant number of variable rate fluctuations are introduced, the overall behavior of perforation opening is expected to behave as a sigmoid function FIG. 9 shows the schematics of possible experimental design and FIG. 10 shows the expected behavior of data from proposed testing. Note that the final measurement point r-sdt2 step-down test is conducted immediately after the final variable rate fluctuation before proppant is pumped. Previous testing has found that open perforations observed at r-sdt1 & r1 are similar if not the same. With the proposed experimental design, the open perforation count from rk & r-sdt2 observations are expected to be same/similar.

While in the scenario depicted in FIG. 9, the variable rate fluctuations are straddled with two separate rate step-down tests, in other alternate designs, either or both of the two straddling step-down tests can be discarded. The implication in terms of possible advantages or issues with each of these alternatives will be discussed briefly. A primary purpose for having the pre- (r-sdt1) and post- (r-sdt2) rate step-down tests is to estimate the number of open perforations both before and after variable rate fluctuations are introduced. This helps to accurately predict the open perforation count for each of the rate drops and ensure that the calculated values tie with another similar yet independent set of calculations. This is because the results from the first step-down test can be used to constrain the r-prior estimate for the first rate fluctuation. The final rate step-down test provides a control point to make sure that the estimated values from all the variable rate fluctuations tie together with minimized error in estimates.

In another variation, the initial and final rate step-down test are discarded and the rate fluctuations are followed directly by proppant injection. While this scheme will generally not allow for an accurately constrained solution, it can still allow useful data points for design and diagnostics. In accordance with one embodiment, to increase or maximize the number of possible open perforations, the number of rate fluctuations is desirably required to be sufficiently high. In order to design this in the field, it is necessary to see if asymptotic behavior is being approached in terms of open perforations. The generation of perforation "synthetic curves" is proposed as a means to determine the overall response of variable pulse fracturing and its effectiveness. These curves quantify the change in number of open perforations at the end of the introduced fluctuation being studied and help describe the response behavior in terms of perforations with variable rate fluctuations. Evaluation using these synthetic curves involve identifying open perforations at any observation point and plotting it on the curves to identify trend behavior. Note that for referencing data from these curves, the evaluated number of open perforations will have to be normalized for data from each experiment using feature scaling to limit all observed values between 0 & 1, i.e., to have standardized range. FIG. 1 shows three possible scenarios indicating early, gradual or late jumps in open perforations for a test case. Here, the initial number of perforations is known to be 24 (based on step-down test or analysis of first variable rate fluctuation) and maximum number of possible open perforations ($r_{maximum}$) is 48. For design purposes, those behaving as the former require less number of rate fluctuations while those behaving as the latter require more rate drops with potentially higher ΔQ. At the same time, the three highlighted scenarios vary in terms of final open perforations that could be attained through introduction of variable rate pulses. The decision in terms of design or additional rate fluctuations can either be done subjectively based on how the opening behaves or soft computing tools such as Fuzzy decision systems can be used for this. As an example, normalized open perforations from prior rate fluctuation can be used as well as gradient (difference) function over all prior rate fluctuations as inputs to such a decision system. Other parameters for design could include ratio of area under the traced perforation curve to the area under the curve corresponding with "$r_{maximum}$".

Figure 12:
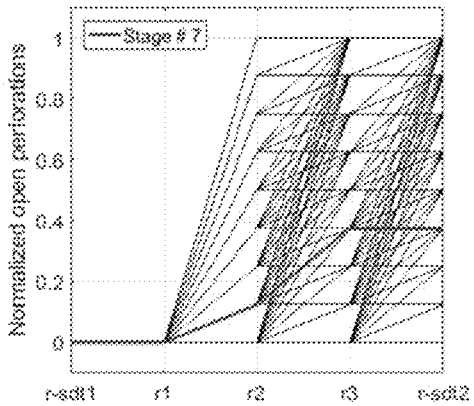
FIG. 12 is a graphical presentation of observed opening of perforations for a treatment stage from the Permian Basin in accordance with one embodiment of the subject development.

In accordance with one preferred embodiment, the final asymptotic behavior should never exceed $r_{maximum}$ (i.e., 1 on the normalized curves) as per the perforation design for the hydraulic fracturing stage in question and for most stages should be significantly lower than $r_{maximum}$. FIG. 12 shows actual data from one of the stages from the Permian Basin where proposed experimental design was implemented and for which the asymptotic behavior towards the end and overall fit in relation to the synthetic curves can be clearly seen.

From FIG. 12, it can clearly be seen that the design has not been optimized since additional variable rate fluctuations were not applied to see if additional perforations could be opened. The observed behavior was similar to Case II highlighted in FIG. 4. A sigmoid behavior, as proposed above, was also not seen. There was a slight difference (of 1 perforation count) between r-sdt1 and r1 (the "r" calculations were not constrained based on observed open perforations from r-sdt1 calculation). The following design workflow is proposed to design these variable rate fluctuations:

1. Introduce a single variable rate fluctuation once the flow has adequately stabilized post breakdown. Calculate the number of open perforations before and after introduced variable rate fluctuation. Wait for steady state treating pressure before introducing additional variable rate fluctuations.
2. Normalize the data and plot the perforation data as an overlay on the modeled synthetic curves. If the data trend remains close to zero on the synthetic curves (i.e., significant perforations do not open initially), adjust (increase) variable rate fluctuation parameter (ΔQ, frequency, etc.).
3. Repeat steps 1 & 2 with data from each evaluation step. Repeat until close to one of the asymptotic limits is reached as per the fit from the synthetic curves. Alternately, use a fuzzy decision system to decide on rate drop design parameters and termination of additional drops.

Scheme B: Sequentially compare open perforations after each variable rate fluctuation In this scheme, the number of open perforations at the end of prior variable rate fluctuation and post the current variable rate fluctuation are compared and a design decision is made based on either large or negligible/no difference between these data points. Other parameters could also be used for design which may or may not involve a fuzzy decision system.

While this approach towards design workflow for these variable rate fluctuations may be simpler, as for example it does not require synthetic curve generation, the final design might remain suboptimal since only the last few data points are compared for design decisions and therefore, overall trend behavior as far as opening of additional perforations are not considered.

Summary

Thus, a method is proposed to make use of rapid rate fluctuations introduced as part of the subject variable rate fracture technique to identify additional perforations that open as a result of said rate fluctuations. The proposed method develops and expands upon the existing technique of using a step-down test but without requiring an actual drop in flow rate after each rate fluctuation. The solutions are non-unique by the very nature of problem as described earlier but an estimate of change in the number of open perforations can be obtained which can be used as a diagnostic tool to quantify the effectiveness of using pulse fracturing technique as well as a design tool to decide when to stop these rapid rate fluctuations. With more or additional open perforations, the expectation is that more fluid flow channels will develop from the perforations at the wellbore into the subsurface rock formation leading to reduction in bypassed zones and a more effective stimulation overall.

Thus, in accordance with one embodiment, there is provided a method of hydraulic fracturing to create a number of additional open perforations in an earth formation having a total number of perforations, the method comprising:

a. pumping a fracturing fluid into the earth formation at a first pressure ($P_1$) and a first flow rate ($Q_1$);
b. pumping the fracturing fluid into the earth formation at a second pressure ($P_2$) and a second flow rate ($Q_2$) to introduce a change of flow rate into the earth formation for a period of time, where the second flow rate ($Q_2$) is significantly reduced as compared to the first flow rate ($Q_1$);
c. return pumping of the fracturing fluid into the earth formation at the first flow rate (where the flow rate on said return of the pumping is designated ($Q_R$)), and identifying a pumping pressure ($P_R$) associated with the flow rate on said return of the pumping ($Q_R$); and
d. calculating the number of additional open perforations and a total number of open perforations in the earth formation.

As set forth above, in a preferred embodiment, such significantly reduced second flow rate may range from 25% to 75% lower that the initial flow rate.

Further, such method may further involve repeating steps b, c, and d including, for example in some embodiments, such repeating wherein the pressure and flow rate of the fracturing fluid in repeated step b are different from the pressure and flow rate of the fracturing fluid in initial step b as well as in some embodiment, such repeating wherein the pressure and flow rate of the fracturing fluid in repeated step b are unchanged from the pressure and flow rate of the fracturing fluid in initial step b.

In some embodiments, steps b, c, and d are repeated until such time as wherein, in successive iterations, the number of additional open perforations decreases and the total number of open perforations is at least 90% of the total number of perforations.

In some embodiments, in successive iterations, the number of additional open perforations decreases and the total number of open perforations is no more than 75% of the total number of perforations, the method additionally comprises, in the next iteration, aggressive altering of at least one fracturing fluid operation parameter selected from the group of flow rate, duration, and frequency, wherein said aggressive altering of flow rate comprises employing a $Q_2/Q_1$ ratio of less than 40%; wherein said aggressive altering of duration comprises employing a duration of less than 20 seconds between when $Q_1$ is changed and when $Q_R$ is achieved; and wherein said aggressive altering of frequency comprises employing more than one cycle per minute.

In some embodiments, in successive iterations, the number of additional open perforations increases or remains unchanged and the total number of open perforations is more than 75% of the total number of perforations, the method additionally comprises, in the next iteration, conservative altering of at least one fracturing fluid operation parameter selected from the group of flow rate, duration, and frequency, wherein said conservative altering of flow rate comprises employing a $Q_2/Q_1$ ratio of greater than 40%; wherein said conservative altering of duration comprises employing a duration of greater than 20 seconds between when $Q_1$ is changed and when $Q_R$ is achieved; and wherein said conservative altering of frequency comprises employing less than one cycle per minute.

In some embodiments, in successive iterations, the number of additional open perforations increases and the total number of open perforations decreases or remains unchanged, the method additionally comprises, in the next iteration, applying the fracturing fluid operation parameters of the preceding iteration.

In some embodiments, the method of may additionally involve calculating an uncertainty value for at least one of the number of additional open perforations and the total number of open perforations in the earth formation.

In some embodiments, such as wherein the uncertainty value is greater than 5% and less than 15%, the method additionally involves repeating steps b, c, and d without altering fracturing fluid operation parameters of flow rate, duration, and frequency.

In some embodiments, such as wherein the uncertainty value is at least 15%, the method additionally involves repeating steps b, c, and d with a conservative altering of at least one fracturing fluid operation parameter selected from the group of flow rate, duration, and frequency, wherein said conservative altering of flow rate comprises employing a $Q_2/Q_1$ ratio of greater than 40%; wherein said conservative altering of duration comprises employing a duration of greater than 20 seconds between when $Q_1$ is changed and when $Q_R$ is achieved; and wherein said conservative altering of frequency comprises employing less than one cycle per minute.

Water Hammer Pressure Transient Analysis

Water hammer pressure transient analysis (or as sometimes referred to herein as "pressure pulse attenuation analysis") is a way of extracting information from productive reservoir volume (SRV) created during hydraulic fracturing process using pressure response to unsteady state conditions. A transient state pressure response modeling approach is proposed to identify and isolate issues with completion and show how the accompanying analysis can be used routinely to optimize completions in real time and generally improve production performance from fracture stages. This methodology does not require any additional data collection but can provide significant potential for improving understanding of the effective productive reservoir volume. In essence, the water hammer response observed at various stages of the treatment is modeled so as to match the modeled transient response with observations and identify model parameters.

Two specific parameters of interest evaluated in this analysis include: 1) the fractured rock volume (VRock) which is an analog to SRV and is indicative of how productive a stage might be and 2) an inter-stage isolation parameter (LOF) which identifies potential inter-stage isolation issues. Real time treatment and completion diagnostics can be very useful in understanding the effectiveness of the proposed hydraulic fracturing method and allow for immediate or medium term remediation. The proposed use of PPA completion diagnostics and optimization workflow is fast enough to be done in near-real time, accurate enough to be of practical use and finally, is very economical. The proposed method provides direct indicators for inter-stage isolation issues as well as completion quality. The modeled parameters can be used to carry out fracture diagnostics during, and at the end of, the treatment and help optimize stimulations in progress.

"Water Hammer" pressure transients are generated when there is a sudden change in flow conditions within a wellbore such as a pump shut in or failure, or sudden rate fluctuations. Classically; water hammer flow and pressure response data at the end of hydraulic fracturing treatment has been used to estimate entry friction. Also, modeling of fluid transients to characterize fracture dimensions, etc. has been studied by others. However, these methods were devised for characterization of single vertical completions and they require extension to be applicable to horizontal mile long laterals. More recently, attempts have been made to utilize these pressure transients to understand the created hydraulic fractures and other aspects of completion such as quality and effectiveness.

In one embodiment, estimated $V_{Rock}$ along with degree of fluid loss can be used to understand completion effectiveness. The "number of additional open perforations" can be correlated with the modeled productive rock volume, resulting in the finding of a strong positive correlation between the two parameters. This indicates that the additional perforations opened as a result of rate changes or pulses introduced in the subject hydraulic fracturing design potentially results in significant boost in productivity from stimulated stage. This makes intuitive sense since additional perforations result in propped open fractures connected to wellbore resulting in higher estimated $V_{Rock}$.

Figure 13:
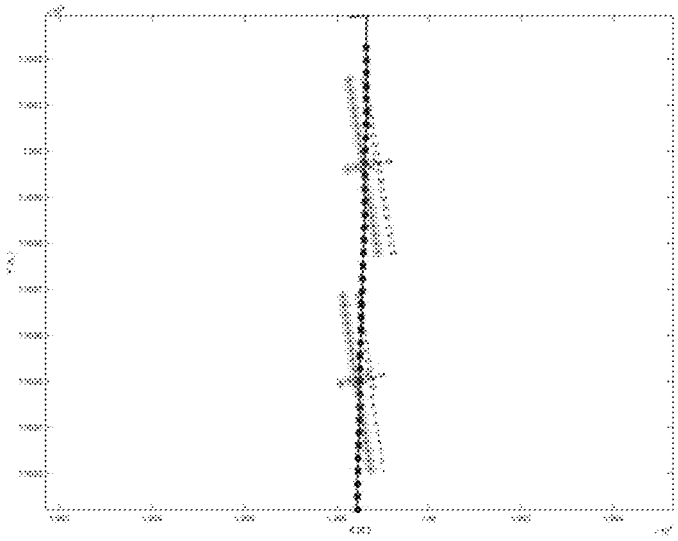
FIG. 13 is a graph showing surface geophone locations and borehole projection at 1000's of feet below surface in accordance with one embodiment of the subject development.

In the past, microseismic emission mapping has been observed to be a very useful tool for fracture diagnostics. However, instead of using traditional surveys involving hundreds of surface geophones of wellbore geophone deployment which is limited in coverage due to acquisition geometry and faces other issues such as cost and well availability, the use of a "mini surface array" is here proposed. FIG. 13 shows a possible deployment pattern for such an array but other alternatives in terms of design such as types of geophones used, placement of geophones, etc. can be varied depending on multiple design criteria. Apart from surface placement, current practice of downhole geophone placement can also be used for similar analysis. In another embodiment, both surface and borehole instrumentation (geophones/accelerometers) are used to map the emissions.

The workflow for analyzing the surface data involves mapping seismic attributes traditionally not mapped in microseismic surveys. This includes using attributes such as dominant frequency as well as average bandwidth mapped continuously over the entire treatment and using the same to understand the effectiveness of rate fluctuation treatments being introduced as part of our hydraulic fracture design approach. This involves using an estimated moveout based on calculated travel times for any event occurring in the subsurface for a particular stage being treated and using the moveout to select multiple "arrival windows" at each point in time during treatment. Within this window, the presence of any energy from potential microseismic event will be detectable using attributes such as "total energy", "dominant frequency", "average bandwidth", "signal coherence", "maximum energy", etc. Other signal processing techniques such as use of filters (bandpass, etc.), beamformers (adaptive, time delay and sum, etc.) is also possible as it helps removes coherent and incoherent noise artifacts that may otherwise influence our interpretations at a later stage.

Based on analysis of the behavior of these attributes close to introduced rate pulses with our hydraulic fracturing method, whether the said rate pulses were "effective" or "not effective" can be deduced. This helps in deciding on number of rate fluctuations and their temporal distribution during treatment. Artificial intelligence (AI) tools can be used to identify the efficacy of said rate pulses in the subject processing.

Predictive models to understand what could be expected in terms of emission behavior or other observable changes when introducing said rate fluctuations are developed. Such to models can use an artificial neural network based classifier (could use multiple variations in terms of network design). They could also use other classifiers such as fuzzy classification techniques or hybrid techniques, etc. Even simple regression could be used. Once correlations are identified, the attributes to use for our diagnostic analysis are identified in real time.

Figure 14:
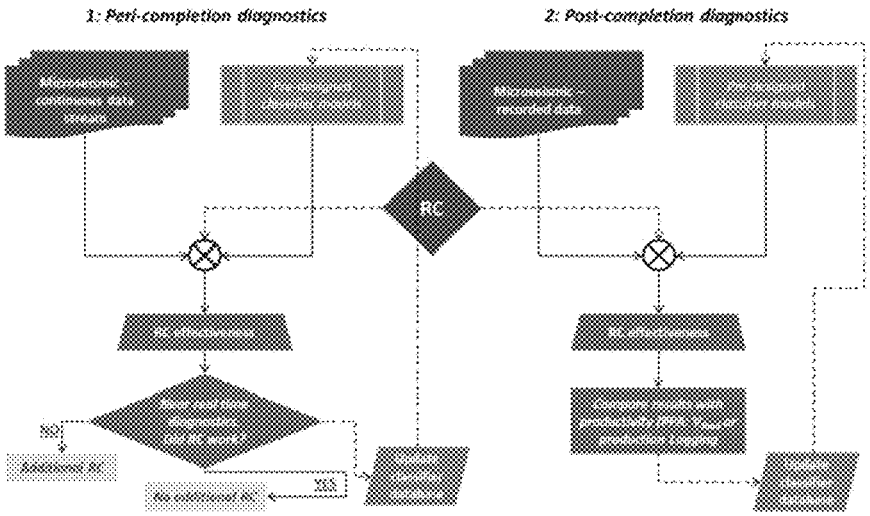
FIG. 14 is a simplified flow schematic for using microseismic attributes to diagnose completion effectiveness in accordance with one embodiment of the subject development.

Classification trials can be used to help narrow the search and to focus on a few identified attributes of interest. Other attributes can also be analyzed in a similar fashion and could be studied as needed. FIG. 14 shows two possible ways of using this approach to diagnose completions and help design the subject hydraulic fracturing processing.

The diagnostic approach devised for the subject hydraulic fracturing method has been implemented in a software toolbox which incorporates all of the data handling and data analysis elements for real time application in the field during hydraulic fracturing operations as well as post completion using the data collected during field activities. In accordance with one preferred practice of the subject development, one way envisioned for combining different attributes showing high dependence in the subject diagnostic approach is to select desired attributes and associated classification models and then based on output from all selected models, a composite score is computed which provides the "effectiveness" and "confidence" measures in the output. These are then used to decide on further rate fluctuations as envisioned to be part of subject hydraulic fracturing method.

Using Treatment Pressure Data to Decide on Optimal Time for Introducing Rate Fluctuations As a diagnostic tool, the treatment pressure can be used to understand fracturing behavior during treatment. In accordance with one embodiment, a modified approach to fracture propagation/growth behavior as originally suggested by Nolte & Smith (1981) and further expanded by Pirayesh at al. (2013) is used. This computed attribute is referred to herein as "modified nolte index". The modified parameter is computed in real time and the mapped attribute is verified for local temporal behavior. Rapid fluctuations in said parameter are used as an indicator of interaction of propagating hydraulic fracture with natural fracture swarms of fracture activation due to local stress perturbations. The degree of fluctuation are quantified and used to determine the necessity of additional "rate drops" at any given time during treatment.

Thus, the invention provides an improved hydraulic fracturing process that provides increased hydrocarbon production without the shortcomings of known processes.

It will be appreciated that details of the foregoing embodiments, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, particularly of the preferred embodiments, yet the absence of a particular advantage shall not be construed to necessarily mean that such an embodiment is outside the scope of the present invention.

What is claimed is:

1. A method of hydraulic fracturing to create a number of additional open perforations in an earth formation having a total number of perforations, the method comprising:

a. pumping a fracturing fluid into the earth formation at a first pressure ($P_1$) and a first flow rate ($Q_1$);

b. pumping the fracturing fluid into the earth formation at a second pressure ($P_2$) and a second flow rate ($Q_2$) to introduce a change of flow rate into the earth formation for a period of time, where the second flow rate ($Q_2$) is significantly reduced as compared to the first flow rate ($Q_1$);

c. return pumping of the fracturing fluid into the earth formation at the first flow rate, where the flow rate on said return of the pumping is designated ($Q_R$), and identifying a pumping pressure ($P_R$) associated with the flow rate on said return of the pumping ($Q_R$); and d. calculating the number of additional open perforations and a total number of open perforations in the earth formation.

2. The method of claim 1 additionally comprising:

repeating steps b, c, and d.

3. The method of claim 2 wherein the pressure and flow rate of the fracturing fluid in repeated step b are different from the pressure and flow rate of the fracturing fluid in initial step b.

4. The method of claim 2 wherein the pressure and flow rate of the fracturing fluid in repeated step b are unchanged from the pressure and flow rate of the fracturing fluid in initial step b.

5. The method of claim 2 wherein steps b, c, and d are repeated until such time as wherein, in successive iterations, the number of additional open perforations decreases and the total number of open perforations is at least 90% of the total number of perforations.

6. The method of claim 2 wherein, in successive iterations, the number of additional open perforations decreases and the total number of open perforations is no more than 75% of the total number of perforations, the method additionally comprises, in the next iteration, aggressive altering of at least one fracturing fluid operation parameter selected from the group of flow rate, duration, and frequency, wherein said aggressive altering of flow rate comprises employing a $Q_2/Q_1$ ratio of less than 40%; wherein said aggressive altering of duration comprises employing a duration of less than 20 seconds between when $Q_1$ is changed and when $Q_R$ is achieved; and wherein said aggressive altering of frequency comprises employing more than one cycle per minute.

7. The method of claim 2 wherein, in successive iterations, the number of additional open perforations increases or remains unchanged and the total number of open perforations is more than 75% of the total number of perforations, the method additionally comprises, in the next iteration, conservative altering of at least one fracturing fluid operation parameter selected from the group of flow rate, duration, and frequency, wherein said conservative altering of flow rate comprises employing a $Q_2/Q_1$ ratio of greater than 40%; wherein said conservative altering of duration comprises employing a duration of greater than 20 seconds between when $Q_1$ is changed and when $Q_R$ is achieved; and wherein said conservative altering of frequency comprises employing less than one cycle per minute.

8. The method of claim 2 wherein, in successive iterations, the number of additional open perforations increases and the total number of open perforations decreases or remains unchanged, the method additionally comprises, in the next iteration, applying the fracturing fluid operation parameters of the preceding iteration.

9. The method of claim 1 additionally comprising:

calculating an uncertainty value for at least one of the number of additional open perforations and the total number of open perforations in the earth formation.

10. The method of claim 9 wherein the uncertainty value is greater than 5% and less than 15%, the method additionally comprises repeating steps b, c, and d without altering fracturing fluid operation parameters of flow rate, duration, and frequency.

11. The method of claim 9 wherein the uncertainty value is at least 15%, the method additionally comprises repeating steps b, c, and d with a conservative altering of at least one fracturing fluid operation parameter selected from the group of flow rate, duration, and frequency, wherein said conservative altering of flow rate comprises employing a $Q_2/Q_1$ ratio of greater than 40%; wherein said conservative altering of duration comprises employing a duration of greater than 20 seconds between when $Q_1$ is changed and when $Q_R$ is achieved; and wherein said conservative altering of frequency comprises employing less than one cycle per minute.

12. A method of hydraulic fracturing to create a number of additional open perforations in an earth formation, the method comprising:

a. pumping a fracturing fluid into the earth formation at a first pressure ($P_1$) and a first flow rate ($Q_1$);

b. pumping the fracturing fluid into the earth formation at a second pressure ($P_2$) and a second flow rate ($Q_2$) to introduce a change of flow rate into the earth formation for a period of time, where the second flow rate ($Q_2$) is significantly reduced as compared to the first flow rate ($Q_1$);

c. return pumping of the fracturing fluid into the earth formation at the first flow rate, (where the flow rate on said return of the pumping is designated ($Q_R$), and identifying a pumping pressure ($P_R$) associated with the flow rate on said return of the pumping ($Q_R$); and d. comparing the pumping pressure associated with return to the first flow rate ($P_R$) with the first pressure ($P_1$) and correspondingly adjusting at least one fracturing fluid operation parameter selected from the group of flow rate, duration, and frequency.

13. The method of claim 12 wherein steps b, c and d are repeated a plurality of iterations.

14. The method of claim 13 wherein, in successive iterations, $P_R>P_1$ and $Q_R=Q_1$, the method additionally comprises, in the next iteration, aggressive altering of at least one fracturing fluid operation parameter selected from the group of flow rate, duration, and frequency, wherein said aggressive altering of flow rate comprises employing a $Q_2/Q_1$ ratio of less than 40%; wherein said aggressive altering of duration comprises employing a duration of less than 20 seconds between when $Q_1$ is changed and when $Q_R$ is achieved; and wherein said aggressive altering of frequency comprises employing more than one cycle per minute.

15. The method of claim 14 additionally comprising:

calculating a total number of open perforations in the earth formation.

16. A method of hydraulic fracturing to create a number of additional open perforations in an earth formation, the method comprising:

a. pumping a fracturing fluid into the earth formation at a first pressure ($P_1$) and a first flow rate ($Q_1$);

b. pumping the fracturing fluid into the earth formation at a second pressure ($P_2$) and a second flow rate ($Q_2$) to introduce a change of flow rate into the earth formation for a period of time, where the second flow rate ($Q_2$) is significantly reduced as compared to the first flow rate ($Q_1$);

c. return pumping of the fracturing fluid into the earth formation at the first flow rate, (where the flow rate on said return of the pumping is designated ($Q_R$), and identifying a pumping pressure ($P_R$) associated with return to the first flow rate ($Q_R$); and d. comparing the pumping pressure associated with return to the first flow rate ($P_R$) with the first pressure ($P_1$) to determine one or more of: number of open perforations originally in the earth formation and the number of additional open perforations resulting from the hydraulic fracturing.

17. The method of claim 16 wherein in step d the number of additional open perforations resulting from the hydraulic fracturing is determined and said method additionally comprises:

repeating steps b-d employing a new second flow rate different than the original second flow rate;

comparing the number of additional open perforations resulting from the original second flow rate with the number of additional open perforations resulting from the new second flow rate; and comparing the number of perforations after application of the new second flow rate with the number of open perforations after application of the flow rate in a previous iteration.

18. The method of claim 17 wherein steps b-d are repeated until such time as wherein, in successive iterations, the number of additional open perforations decreases and the total number of open perforations increases.

19. The method of claim 17 wherein, in successive iterations, the number of additional open perforations decreases and the total number of open perforations decreases, the method additionally comprises, in the next iteration, aggressive altering of at least one fracturing fluid operation parameter selected from the group of flow rate, duration, and frequency, wherein said aggressive altering of flow rate comprises employing a $Q_2/Q_1$ ratio of less than 40%; wherein said aggressive altering of duration comprises employing a duration of less than 20 seconds between when $Q_1$ is changed and when $Q_R$ is achieved; and wherein said aggressive altering of frequency comprises employing more than one cycle per minute.

20. The method of claim 17 wherein, in successive iterations, the number of additional open perforations increases, the method additionally comprises, in the next iteration, conservative altering of at least one fracturing fluid operation parameter selected from the group of flow rate, duration, and frequency, wherein said conservative altering of flow rate comprises employing a $Q_2/Q_1$ ratio of greater than 40%; wherein said conservative altering of duration comprises employing a duration of greater than 20 seconds between when $Q_1$ is changed and when $Q_R$ is achieved; and wherein said conservative altering of frequency comprises employing less than one cycle per minute.

21. The method of claim 17 wherein, in successive iterations, the total number of open perforations increases, the method additionally comprises, in the next iteration, conservative altering of at least one fracturing fluid operation parameter selected from the group of flow rate, duration, and frequency, wherein said conservative altering of flow rate comprises employing a $Q_2/Q_1$ ratio of greater than 40%; wherein said conservative altering of duration comprises employing a duration of greater than 20 seconds between when $Q_1$ is changed and when $Q_R$ is achieved; and wherein said conservative altering of frequency comprises employing less than one cycle per minute.

22. The method of claim 17 additionally comprising:

calculating an uncertainty value for the calculated number of open perforations.

* * * * *